US006850714B2

(12) United States Patent
Sakurai et al.

(10) Patent No.: US 6,850,714 B2
(45) Date of Patent: Feb. 1, 2005

(54) IMAGE FORMING APPARATUS, CARTRIDGE, IMAGE FORMING SYSTEM AND STORAGE MEDIUM

(75) Inventors: Kazushige Sakurai, Shizuoka (JP); Kazumi Yamauchi, Shizuoka (JP); Tomomi Kakeshita, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/933,827

(22) Filed: Aug. 22, 2001

(65) Prior Publication Data

US 2002/0025176 A1 Feb. 28, 2002

(30) Foreign Application Priority Data

Aug. 23, 2000 (JP) ..... 2000-252348

(51) Int. Cl.[7] ..... G03G 15/00
(52) U.S. Cl. ..... 399/25; 399/51
(58) Field of Search ..... 399/25, 26, 51, 399/43, 111

(56) References Cited

U.S. PATENT DOCUMENTS

| | | | | |
|---|---|---|---|---|
| 5,272,503 A | | 12/1993 | LeSueur et al. | |
| 5,475,471 A | | 12/1995 | Kisu et al. | |
| 5,534,344 A | | 7/1996 | Kisu et al. | 428/323 |
| 5,541,711 A | | 7/1996 | Kisu et al. | |
| 5,765,077 A | | 6/1998 | Sakurai et al. | |
| 6,011,935 A | * | 1/2000 | Matsuzaka et al. | 399/111 |
| 6,229,970 B1 | * | 5/2001 | Onimura et al. | 399/25 |
| 6,351,621 B1 | * | 2/2002 | Richards et al. | 399/111 |

FOREIGN PATENT DOCUMENTS

| | | | | |
|---|---|---|---|---|
| EP | 821285 A1 | * | 1/1998 | G03G/15/00 |
| JP | 58132758 A | * | 8/1983 | G03G/15/00 |
| JP | 05257343 A | * | 10/1993 | G03G/15/00 |
| JP | 09120245 A | * | 5/1997 | G03G/21/18 |
| JP | 10031332 A | * | 2/1998 | G03G/15/00 |
| JP | 10-221938 | | 8/1998 | |

* cited by examiner

*Primary Examiner*—Robert Beatty
(74) *Attorney, Agent, or Firm*—Fitzpatrick, Cella, Harper & Scinto

(57) ABSTRACT

An image forming apparatus has a cartridge detachably mounted thereon, having unitized as one piece, one or more of a photosensitive body on which an electrostatic latent image is formed, a charging device for charging the photosensitive body, and a developing device for developing the electrostatic latent image formed on the photosensitive body and including a storage medium capable of storing electronic information, an exposing device for exposing the photosensitive body, and a device for detecting a used amount of the cartridge. The storage medium has information stored in advance for determining an exposure condition specific to each cartridge and has an area for writing used amount information of the cartridge detected by the detecting device, and performs control for changing the exposure condition of the photosensitive body based on the information for determining the exposure conditions and the used amount information.

21 Claims, 10 Drawing Sheets

IMAGE FORMING APPARATUS, CARTRIDGE, IMAGE FORMING SYSTEM AND STORAGE MEDIUM

BACKGROUND OF THE INVENTION

1. Field of the Invention

The present invention generally relates to an image forming apparatus using an electrophotographic method, a cartridge mountable on this image forming apparatus main body, that is, a process cartridge, a development apparatus rendered as a cartridge, an image forming system, and a storage medium mounted on the cartridge.

Here, the electrophotographic image forming apparatuses include an electrophotographic copier, an electrophotographic printer (such as an LED printer and a laser beam printer), and an electrophotographic facsimile, for instance.

In addition, a cartridge removable from the electrophotographic image forming apparatus refers to the cartridge having at least one of an electrophotographic photosensitive body, charging means for charging the electrophotographic photosensitive body, developing means for supplying developer to the electrophotographic photosensitive body, and cleaning means for cleaning the electrophotographic photosensitive body. In particular, the process cartridge refers to either the cartridge integrating into a cartridge at least one of the charging, development and cleaning means and the electrophotographic photosensitive body and rendering it removable from the electrophotographic image forming apparatus main body, or the cartridge integrating into a cartridge at least the developing means and the electrophotographic photosensitive body and rendering it removable from the apparatus main body.

2. Related Art

Conventionally, in an image forming apparatus using an electrophotographic image forming process, a process cartridge method of integrating into a cartridge an electrophotographic photosensitive body and process means for acting upon the element and rendering it removable from the image forming apparatus main body is adopted. This process cartridge method allows a user to perform maintenance of the apparatus on his or her own without relying on a serviceperson, so that operability can be exceptionally improved. For this reason, the process cartridge method is widely used in the electrophotographic image forming apparatuses.

A method of mounting a memory as storage means on the process cartridge (hereafter, merely referred to as a "cartridge") to store information of the cartridge is also disclosed. For instance, Japanese Patent Application Laid-Open No. 10-221938 proposes to store in memory manufacturing lots, types, developer (toner) types and so on of the cartridges so as to perform quality control of the cartridges.

In addition, there is a proposed method of stabilizing image quality regardless of situation of use by mounting a memory on the cartridge. U.S. Pat. No. 5,272,503 discloses an image forming apparatus for recording in memory at any time the number of printed (duplicated) sheets totalized as an amount of the cartridge used in the apparatus main body and controlling process conditions according to a totalized value of the number of printed sheets. However, in the case where the used amount of a photosensitive drum that is the electrophotographic photosensitive body is rendered as the totalized value of the number of printed sheets as the above-mentioned used amount of the cartridge, there is a defect that its precision is not good. This is because, for instance, A3-sized sheet is counted as one sheet that is the same as A4-sized sheet.

Moreover, there is also a method of directly detecting the used amount of the photosensitive drum from a lowered charged potential of the drum or a reduced latent image contrast by using a surface potential sensor or the like. In this case, however, the surface potential sensor and an electric circuit for processing its output are required, and so the costs become high. In addition, as only the information on the photosensitive drum corresponding to the sensor's position is acquired, there is a possibility of detecting a partial defect, not necessarily capable of acquiring the information along the whole length of the drum.

Furthermore, even if the precise used amount of the cartridge is known, there are cases where it is difficult to render images uniform throughout the usage period of the cartridge. This is because there are some differences in variations in images against the used amount of the cartridge due to manufacturing conditions thereof and so on, and the differences in the images become obvious from the middle to the latter half of the usage period.

As an example of this case, a relationship between the drum's film thickness and a light portion potential VI is shown in FIG. 10. As is understandable from this graph, the light portion potential of the drum has dependence on the film thickness.

Thus, as the cartridge is used for a long period of time, the drum's film thickness is reduced so that the light portion potential changes and the quality of formed images vary. However, a reduced amount of the film thickness varied at times depending on the conditions on manufacturing of the cartridges even though the used amount was the same.

This variation in the reduced amount of the film thickness of the drum is generated by manufacturing variation in contact pressure at a cleaning blade of the cartridge, variation in electric characteristics of the charging means and so on, for instance.

SUMMARY OF THE INVENTION

Accordingly, an object of the present invention is to provide, generally without placing a dedicated sensor and so on, an image forming apparatus a cartridge removable therefrom and an image forming system of simple and inexpensive configuration and capable of acquiring high-quality image with little durable variation.

Another object of the present invention is to provide an image forming apparatus, a cartridge removable therefrom and an image forming system of the simple and inexpensive configuration and capable of controlling an optimum amount of exposure to light based on the precise used amount of the cartridge and acquiring for any cartridge the high-quality image with little durable variation due to manufacturing tolerances thereof.

A further object of the present invention is to provide, generally without placing a dedicated sensor and so on, a storage medium of the simple and inexpensive configuration mounted on the cartridge and capable of contributing to acquisition of high-quality image with little durable variation.

A still further object of the present invention is to provide a storage medium of the simple and inexpensive configuration mounted on the cartridge and capable of controlling the optimum amount of exposure based on the precise used amount of the cartridge and, for any cartridge, contributing to acquisition of high-quality image with little durable variation due to manufacturing tolerances thereof.

To attain the above objects, the image forming apparatus according to the present invention has the cartridge mounted thereon in a removable manner, which has unitized as one piece one or more of a photosensitive body on which an electrostatic latent image is formed, charging means for charging the above described photosensitive body, and developing means for developing the electrostatic latent Image formed on the above described photosensitive body and has the storage medium capable of storing electronic information, the above described apparatus further having exposing means for exposing the above described photosensitive body and means for detecting the used amount of the above described cartridge, and the above described storage medium has threshold information for changing conditions specific to each cartridge and the used amount information of the above described cartridge, where control for changing exposure conditions of the above described photosensitive body is performed based on the above described threshold information and the above described used amount information.

In addition, the cartridge according to the present invention is one that has unitized as one piece one or more of a photosensitive body on which an electrostatic latent image is formed, charging means for charging the above described photosensitive body, and developing means for developing the electrostatic latent image formed on the above described photosensitive body and has the storage medium capable of storing electronic information, and is removable from the image forming apparatus having exposing means for exposing the above described photosensitive body and means for detecting the used amount of the cartridge, where the above described storage medium has threshold information for changing conditions specific to each cartridge and the used amount information of the cartridge stored, so that control for changing exposure conditions of the above described photosensitive body is performed based on the above described threshold information and the above described used amount information.

Furthermore, the image forming system according to the present invention for forming images in the storage medium by using the cartridge removable from the image forming apparatus has a) the cartridge having one or more of the photosensitive body on which an electrostatic latent image is formed, the charging means for charging the above described photosensitive body, and the developing means for developing the electrostatic latent image on the above described photosensitive body, and the storage medium capable of storing and having threshold information for changing conditions specific to each cartridge and the used amount information of the cartridges stored, and b) the image forming apparatus having the exposing means for exposing the above described photosensitive body, the means for detecting the used amount of the above described cartridge, and control means for changing exposure conditions of the above described photosensitive body based on the information in the above described storage medium.

Moreover, the storage medium according to the present invention has threshold information for changing conditions specific to each cartridge and the used amount information of the cartridges stored therein, the above described storage medium capable of storing the electronic information and mounted on the cartridge removable from the image forming apparatus main body having unitized as one piece one or more of the photosensitive body on which an electrostatic latent image is formed, the charging means for charging the above described photosensitive body, and the developing means for developing the electrostatic latent image formed on the above described photosensitive body.

According to an embodiment of the above inventions, the used amount information of the above described cartridge is the information representing the amount that changes according to use of the cartridge.

According to another embodiment of the above inventions, the threshold information for changing conditions specific to the above described cartridge is the information written according to characteristics of each individual cartridge on manufacturing thereof In addition, the used amount information of the above described cartridge is rotation time of the above described photosensitive body, the above described charging means or the above described developing means, bias application time for the above described charging means or the above described developing means, a remaining amount of toner, the number of printed sheets, the number of image dots making an image on the above described photosensitive body, a totalized value of luminescent time of a laser when exposing the above described photosensitive body, film thickness of the above described photosensitive body, or values combined by assigning weights to the respective used amounts.

Moreover, according to a further embodiment, the above described exposure conditions are changed when the used amount of the above described cartridge reaches the threshold. In addition, the above described exposure conditions are exposed light quantities. Furthermore, the above described storage medium has a table corresponding to the above described threshold and the above described exposure conditions.

In addition, according to a still further embodiment of the above inventions, the above described cartridge is a process cartridge including at least the above described photosensitive body, the above described charging means and the above described developing means.

According to the image forming apparatus, the cartridge and the image forming system of the present invention, the storage medium mounted on the cartridge has the threshold information for changing conditions specific to each cartridge and the used amount information of the above described cartridge stored therein and is capable of properly controlling the amount of exposure depending on the usage situation of the photosensitive body according to each cartridge by changing the exposure conditions based on the above described threshold information and the above described used amount information, so that it can, generally without placing a dedicated sensor and so on, acquire a high-quality image with little durable variation with the simple and inexpensive configuration. Moreover, it is possible to control the optimum amount of exposure to light based on the precise used amount of the cartridge and acquire for any cartridge the high-quality image with little variation due to manufacturing tolerances thereof with the simple and inexpensive configuration.

Furthermore, as the storage medium of the present invention has the threshold information for changing conditions specific to each cartridge and the used amount information of the above described cartridge stored, it can contribute, generally without placing a dedicated sensor and so on, to acquisition of high-quality image with little durable variation with the simple and inexpensive configuration. In addition, it can contribute, for any cartridge, to formation of high-quality images with little variation due to manufacturing tolerances with the simple and inexpensive configuration.

These and other objects, features and advantages of the present invention will become more apparent upon consideration of the following description of the preferred embodiments of the present invention taken in conjunction with the accompanying drawings.

DETAILED DESCRIPTION OF THE PREFERRED EMBODIMENTS

Hereafter, preferable embodiments of an image forming apparatus, a cartridge, an image forming system and a storage medium involved in the present invention will be described in detail by referring to the attached drawings.

Embodiment 1

Figure 1:
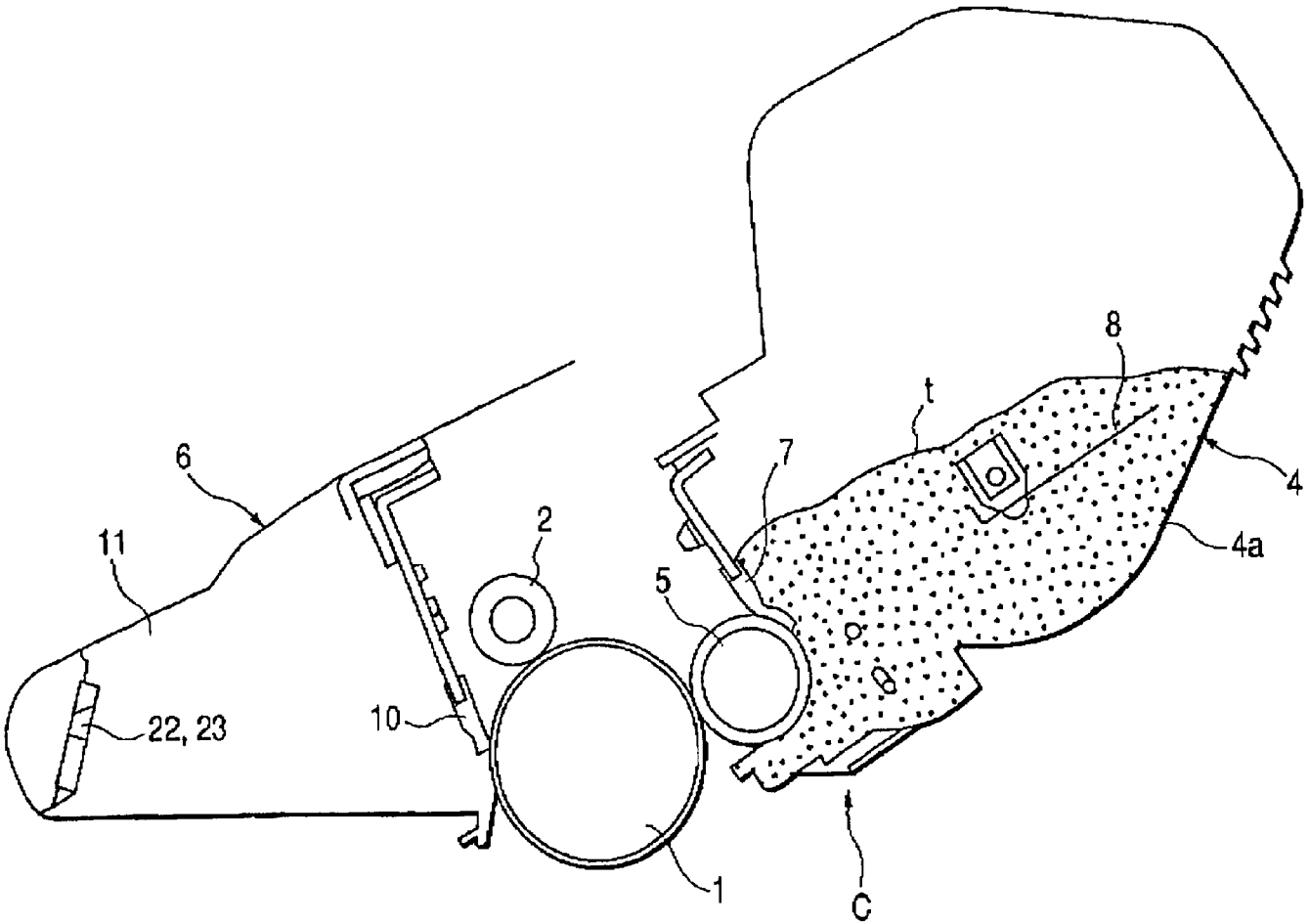
FIG. 1 is a sectional view showing an embodiment of a process cartridge involved in the present invention.

First, an embodiment of an electrophotographic image forming apparatus from which a cartridge configured according to the present invention is removable will be described by referring to FIG. 1 and FIG. 2. The image forming apparatus of this embodiment is a laser beam printer for receiving image information from a host computer and outputting an image, that is, the electrophotographic image forming apparatus wherein a photosensitive drum as an electrophotographic photosensitive body, other process means, and consumables such as toner as a developer are configured as one piece to be removable and replaceable as a process cartridge from the electrophotographic image forming apparatus main body.

A process cartridge C in this embodiment is comprised as one piece of a photosensitive drum 1, a contact charging roller 2 that is charging means for uniformly charging the photosensitive drum 1, a development sleeve 5 as developing means placed counter to the photosensitive drum 1, a toner container 4*a* as a developer accommodating portion linked to the development sleeve 5 and accommodating toner t, a cleaning blade 10, and cleaning means 6 having a waste toner container 11 for accommodating residual toner eliminated from a photosensitive body 1 by the cleaning blade 10.

This process cartridge C is mounted by a user in a removable manner on mounting means 30 provided to the image forming apparatus main body.

The charging roller 2 is a conductive elastic body formed on a core surface, where both ends of the core are kept freely rotatable, and is pressure-welded to an outer face of the photosensitive drum 1 by predetermined pressure so as to rotate according to rotation of the photosensitive drum 1. The charging roller 2 undergoes, via the core from a high voltage power supply provided in the image forming apparatus main body, application of a superimposed voltage (Vac+Vdc) of an AC component Vac and a DC component Vdc having an inter-peak voltage Vpp that is twice or more of a charge start voltage, and the outer face of the photosensitive drum 1, being rotated, uniformly undergoes a contact charging process by an AC application method.

As for a charging bias applied to the charging roller 2, DC voltage; −600 V, AC voltage: sine wave, frequency: 1500 Hz and effective current value: 1400 $\mu$A are applied. A charged potential of the photosensitive drum 1 is charged at Vd=−600 V, and the potential of a laser exposure portion is rendered as VL=−150 V so as to render the VL portion as reversal developing.

The development sleeve 5 is a non-magnetic aluminum sleeve of a 16 mm diameter, and its surface is coated with a resin layer containing conductive grains. There is a four-pole magnet roll placed in the development sleeve 5, which is not illustrated. As a developer controlling member 7, silicone rubber of JIS hardness 40 degrees or so is used on the development sleeve 5 so that abutting (contact) force will be 30 to 40 gf/cm (−0.3 to 0.4 N/cm; contact weight per cm in the direction of sleeve length).

Negative charged magnetic one-component toner is used as the toner t accommodated in the toner container 4a. As for the components, a magnetic body grain 80 parts by weight for a styrene n-butyl-acrylate copolymer 100 parts by weight as a binding resin, two parts of a load current controlling agent of a mono-azo iron complex, and three parts of low molecular weight polypropylene as wax are melted and mixed by a two-axis extruder heated to 140 degrees C., and the cooled mixture is roughly decomposed by a hammer mill, and then the roughly ground matter is pulverized by a jet mill so that the acquired pulverized matter is air classified to acquire classified powder whose weight average diameter is 5.0 $\mu$m. The classified article whose average grain size is 5.0 $\mu$m is mixed with a hydrophobic silica powder 1.0 weight portion by a henschel mixer so as to acquire a developer. And those having a weight average grain size in the range of 3.5 to 7.0 $\mu$m (mainly 6 $\mu$m or so) are used.

As for the development bias applied to the development sleeve 5, DC voltage: −450 V, AC voltage: sine wave, Vpp 1600 V, and frequency: 2200 Hz are applied for instance, in the case where a gap between the photosensitive drum 1 and the development sleeve 5 is 300 $\mu$m or so.

In addition, toner container 4*a* has a toner agitation member 8 inside, which rotates once in six seconds and feeds the toner to a development area while loosening the toner in the toner container 4*a*.

Figure 2:
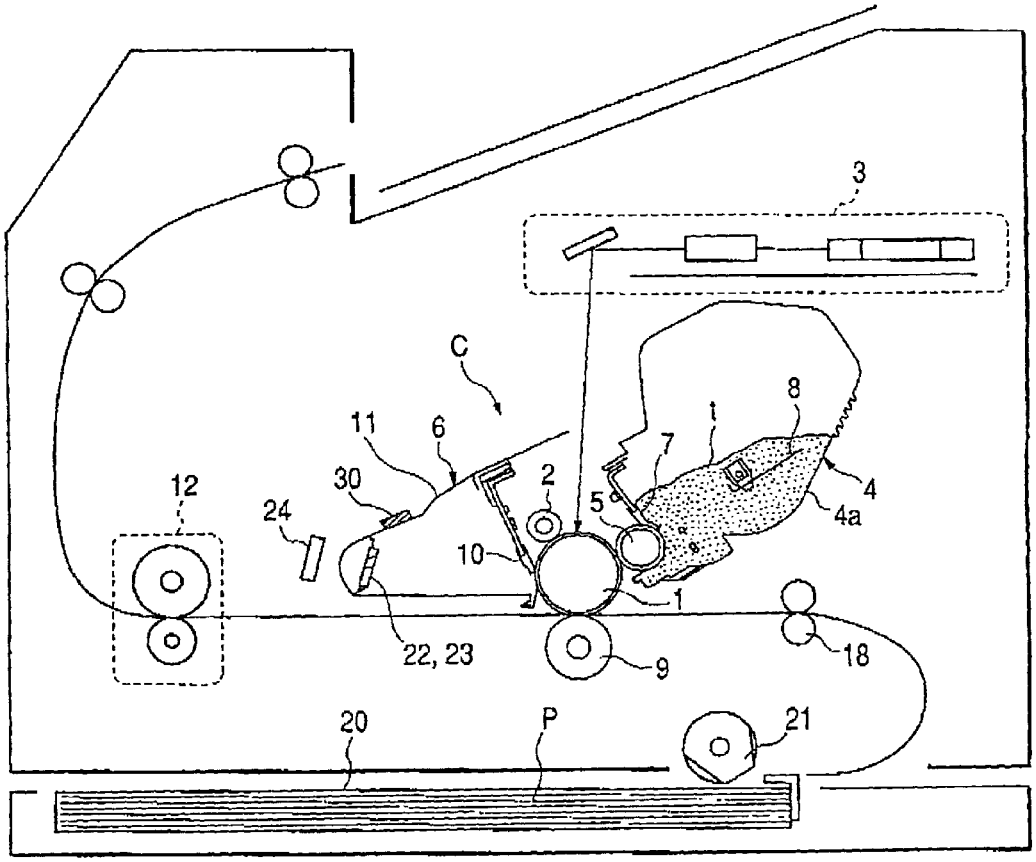
FIG. 2 is a sectional view showing an embodiment of an image forming apparatus involved in the present invention.

In the laser beam printer of this embodiment in FIG. 2, the cylinder-like photosensitive drum 1 as an image holder rotates in one direction centered on its axis. The photosensitive drum 1 has its surface uniformly charged by the charging roller 2, and then has an electrostatic latent image formed by an exposure apparatus (exposing means) 3. The electrostatic latent image formed on the photosensitive drum 1 is visualized as a toner image by supplying the toner t from a developing apparatus 4. The development sleeve 5 has a bias supplying power supply (not shown) connected to it, so that the proper development bias wherein AC bias is superimposed on the above-mentioned DC bias between the photosensitive drum 1 and the development sleeve 5 is given.

On the other hand, a transferring material P that is a recording medium accommodated in a sheet feeding cassette 20 is fed sheet by sheet to a registration roller 18 by a sheet feeding roller 21, and is synchronized with the image on the photosensitive drum 1 and sent to a transferring portion by the registration roller 18.

In the transferring portion, the toner image on the photosensitive drum 1 visualized by the toner t is transferred to the transferring material P by a transferring roller 9. The transferring material P is further carried to a fixing apparatus 12, where the toner image is fixed by heat or pressure to become a recorded image.

After the transfer, the toner not transferred and left on the photosensitive drum 1 is eliminated by the cleaning blade 10 to be accommodated in the waste toner container 11. Thereafter, the photosensitive drum 1 is charged by the charging roller 2 again and repeats the above-mentioned step.

Next, a memory 22 as storage means (storage medium) mounted on the above process cartridge C (hereafter, merely referred to as a "cartridge") will be described.

The cartridge C in this embodiment has the memory 22 and a cartridge-side communication portion 23 for controlling reading and writing of information from and to the memory 22 in a front section in a mounting direction of the waste toner container 11. The cartridge-side communication portion 23 and an apparatus main body control portion 24 are placed, on mounting the cartridge C on the image forming apparatus main body, to oppose each other. Moreover, the apparatus main body control portion 24 also includes a function of communication means on the part of the image forming apparatus main body.

As for the memory used for the present invention, an electronic memory comprised of ordinary semiconductors can be used with no special restrictions In particular, in the case of a non-contact memory for performing data communication between the memory and a read/write IC by an electromagnetic wave, it can be non-contact between the communication portion 23 and an apparatus main body control portion 24 so that there is no longer a possibility of poor contact due to a mounting state of the cartridge C, and thus highly reliable control can be performed.

These two control portions 23 and 24 constitute control means for reading and writing information in the memory 22. As for capacity of the memory 22, it should have sufficient capacity to store a plurality of information such as a used amount of the cartridge and a cartridge characteristic value mentioned later.

In addition, the memory 22 has the used amount of the cartridge C written and stored at any time. There is no special limit to the used amount of the cartridge stored in the memory 22 as long as it can be determined by the image forming apparatus main body. For instance, rotation time of the units such as the photosensitive drum 1, the charging roller 2 and the development sleeve 5, bias application time for the charging roller 2, the development sleeve 5 and so on, a remaining amount of toner, the number of printed sheets, the number of image dots making an image on the photosensitive body, a totalized value of luminescent time of a laser when exposing the photosensitive body, film thickness of the photosensitive body, and values combined by assigning weights to the respective used amounts and so on can be named.

Furthermore, the cartridge characteristic value according to each characteristic of the cartridge on its shipment is a parameter for changing process conditions, and is stored in the memory 22 on factory shipment. As the parameter, a proper value is entered, such as a manufacturing lot of the photosensitive drum, an electrical characteristic value of the charging roller, and contact pressure of the cleaning blade.

And process conditions are controlled from such information stored in the memory 22. To be more specific, the information in the memory 22 is calculated by the cartridge communication portion 23 and the apparatus main body control portion 24, and high pressure output and an amount of exposure to light are changed according to the results of the calculation.

Here, control of image forming process conditions in this embodiment will be described.

Sensitivity of the photosensitive drum to a predetermined amount of exposure varies due to several factors. According to the present inventors, the parameters that can be named as variation factors of sensitivity according to use of the photosensitive drum include the drum's film thickness and characteristics of a photosensitive material comprising the photosensitive drum, for instance. To be more specific, as a capacity value that the photosensitive drum has changes according to the drum's film thickness, the thinner the drum's film thickness is, the more amount of charge is required to attenuate the photosensitive drum having the same dark portion potential to a predetermined light portion potential. Accordingly, in the case the use is continued with the same amount of exposure, there is a phenomenon that the sensitivity gradually deteriorates by an amount of wear according to the use of the photosensitive drum. This amount of wear of the photosensitive drum changes according to its used amount and the cartridge characteristic value.

In addition, the change of the sensitivity is different according to variations in the photosensitive materials comprising the photosensitive drum.

Figure 3:
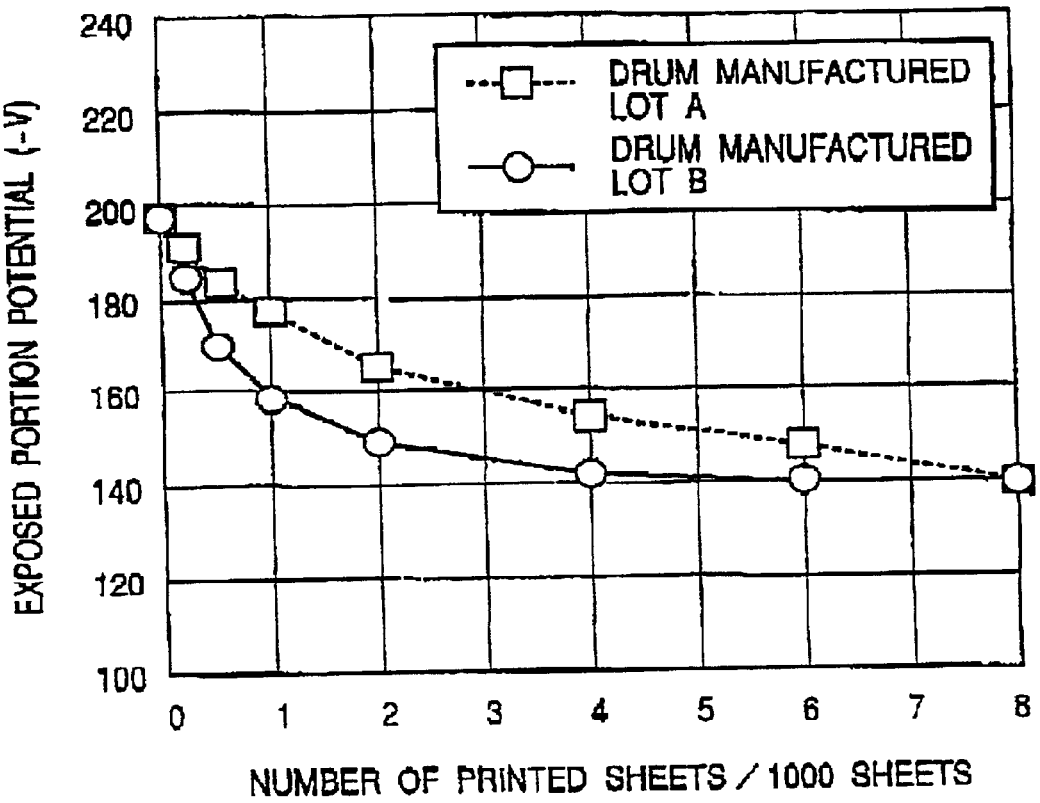
FIG. 3 is a graph showing a relationship between the number of printed sheets and an exposed portion potential in different drum manufacturing lots.

FIG. 3 shows the relationship between the durable number of sheets, that is, the number of printed sheets and the light portion potential, that is, an exposed portion potential of the photosensitive drum whose photosensitive materials are different between manufacturing lots A and B. As is understandable from the drawing, the light portion potential gradually decreases as the number of printed sheets increases in the photosensitive drum of the manufacturing lot A, whereas the potential remarkably decreases at the beginning of printing and there is little change from the middle of the printing operation and thereafter in the drum of the manufacturing lot B. Such variation in the light portion potential due to the use of the photosensitive drum creates a variation in the image.

To hold down such variation in the light portion potential, the amount of exposure should be switched according to the used amount of the photosensitive drum and the cartridge characteristic value. For this reason, the following control is performed in this embodiment.

(1) The cartridge C is equipped with the memory 22 and stores the time during which the cartridge C was driven in the image forming apparatus main body.

(2) The memory 22 stores threshold information on the above used amount determined by the characteristics of the photosensitive materials of the photosensitive drum 1 used on each cartridge and coefficient information on an arithmetic expression determined by contact pressure of the photosensitive drum 1 and the cleaning blade 10 and the electrical characteristic of the charging roller 2.

(3) In the image forming apparatus main body, the used amount of the cartridge C with the driving time and the coefficient information stored in the memory 22 of the cartridge C are calculated, and the calculated value is compared to the threshold information on the used amount of the photosensitive drum in the memory 22 of the cartridge. And the amount of exposure to light is changed when the calculated value becomes the threshold value. Moreover, a table corresponding to the threshold and the amount of exposure to light should be created and stored in the memory 22.

Here, the threshold information stored in the memory 22 of the cartridge can be a plurality, and the amount of exposure to light can be switched a plurality of times. Because of this, it is possible to acquire a stable light portion potential throughout a usage period of the photosensitive drum 1 so that a formed image of higher quality can be implemented.

Configuration of the characteristic portions in this embodiment will be described by referring to FIG. 4 and FIG. 5.

Figure 4:
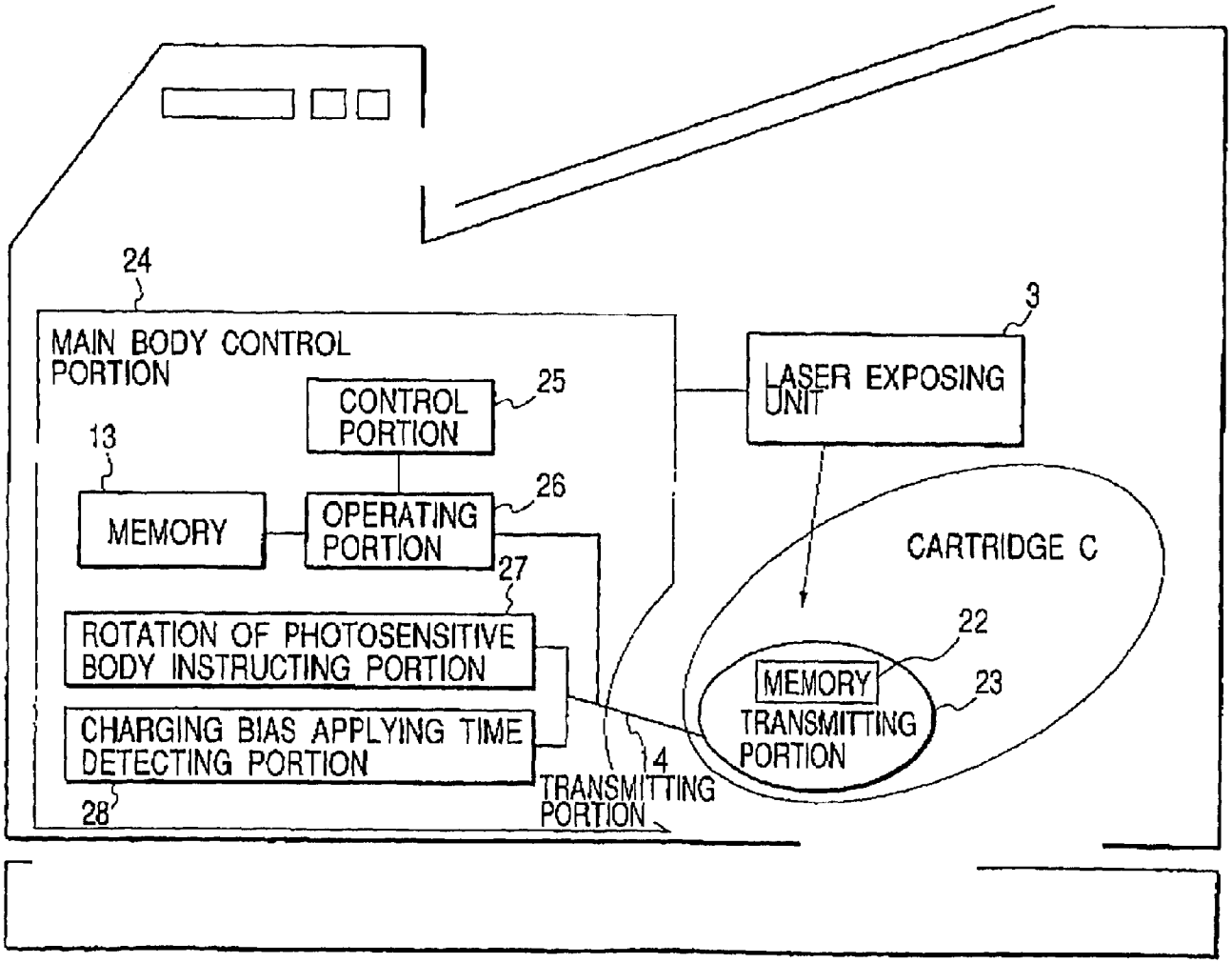
FIG. 4 is a block diagram showing the image forming apparatus and the process cartridge involved in the present invention.

As shown in FIG. 4, the apparatus main body control portion 24 is comprised of a data storage memory 13, a control portion 25, a computing portion 26, a photosensitive body rotation instructing portion 27, a charging bias application time detecting portion 28, apparatus main body communication portion 14 and so on, and is connected to a laser exposure unit (exposing means) 3. In addition, the cartridge C has the memory 22 and the communication portion 23 placed thereon.

Figure 5:
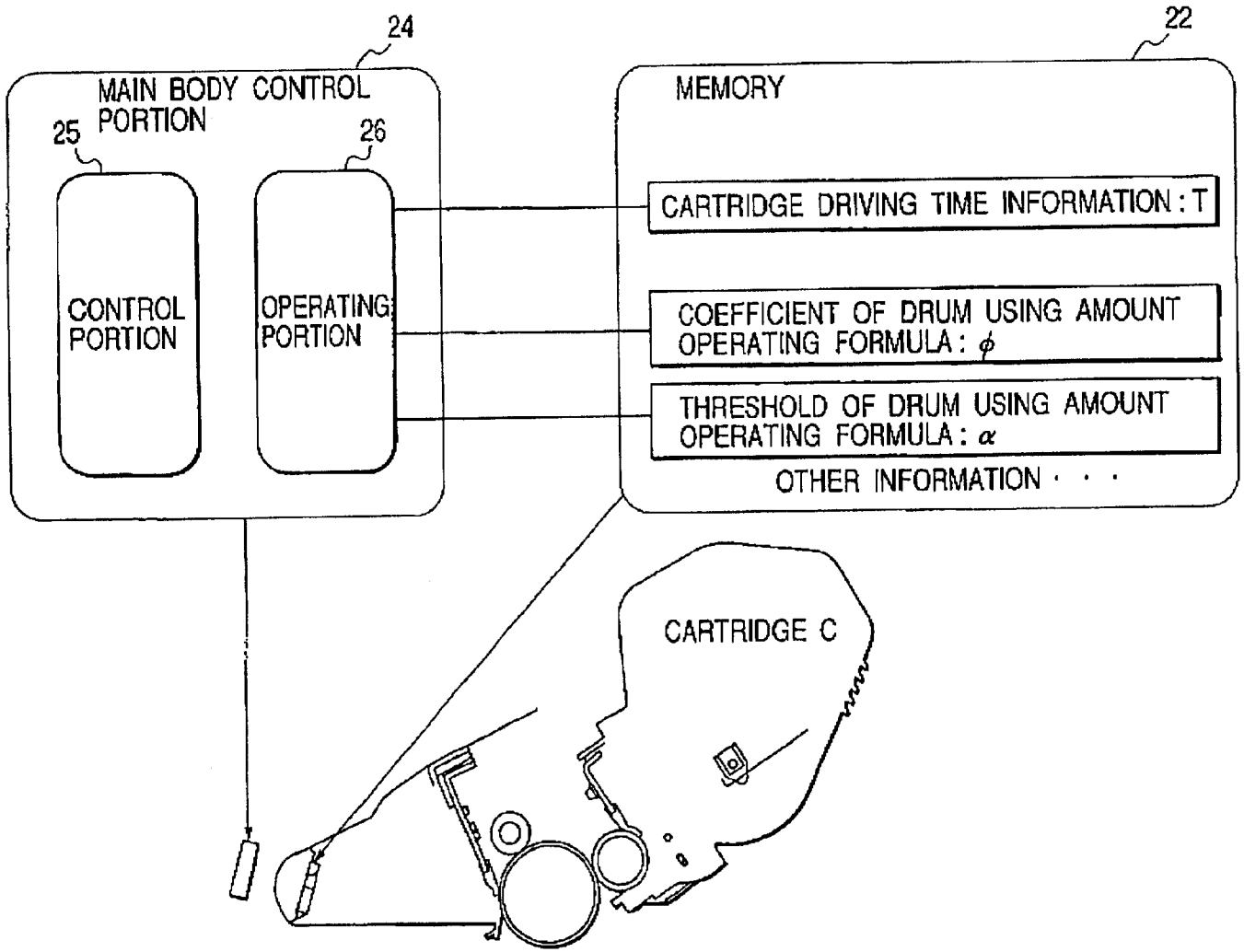
FIG. 5 is a block diagram showing the configuration of memory control involved in the present invention.

In addition, as shown in FIG. 5, the memory 22 in the cartridge C has cartridge driving time information T, and a drum used amount arithmetic expression coefficient $\phi$ and a drum used amount arithmetic expression threshold $\alpha$ that are weighting coefficients and so on stored. Moreover, the drum used amount arithmetic expression threshold $\alpha$ and the drum used amount arithmetic expression coefficient $\phi$ are stored in the memory 22 on shipment. These values change according to the drum sensitivity, the drum materials, the contact pressure of the cleaning blade and the electrical characteristic of the charging roller.

Next, control operation in this embodiment will be described.

When a print signal is received by the image forming apparatus main body, the cartridge C is driven by the photosensitive body rotation instructing portion 27 so as to start an image forming process. In this case, the used amount of the drum is calculated as follows.

A drum used amount D is calculated in the computing portion 26 by a conversion expression $D=A+B\times\phi$ using a value B integrating photosensitive drum rotation time data from the photosensitive body rotation instructing portion 27, a value A integrating charging bias application time data from the charging bias application time detecting portion 28, and the weighting coefficient $\Phi$ read from the memory 22, and is stored in the apparatus main body memory 13 for storing apparatus main body data. The drum used amount D that is integrated and stored is compared to the threshold $\alpha$ in the memory 22 of the cartridge C by the computing portion 26. As a result of the comparison, when the drum used amount D becomes larger than the threshold $\alpha$, a control signal is sent from the control portion 25 to a laser exposure unit 3 so as to change the amount of exposure to light by the laser.

The photosensitive drum rotation time data and the charging bias application time data are stored in the memory 22 at any time, and the drum used amount data is calculated at any time when the drive of the photosensitive drum 1 stops.

Figure 6:
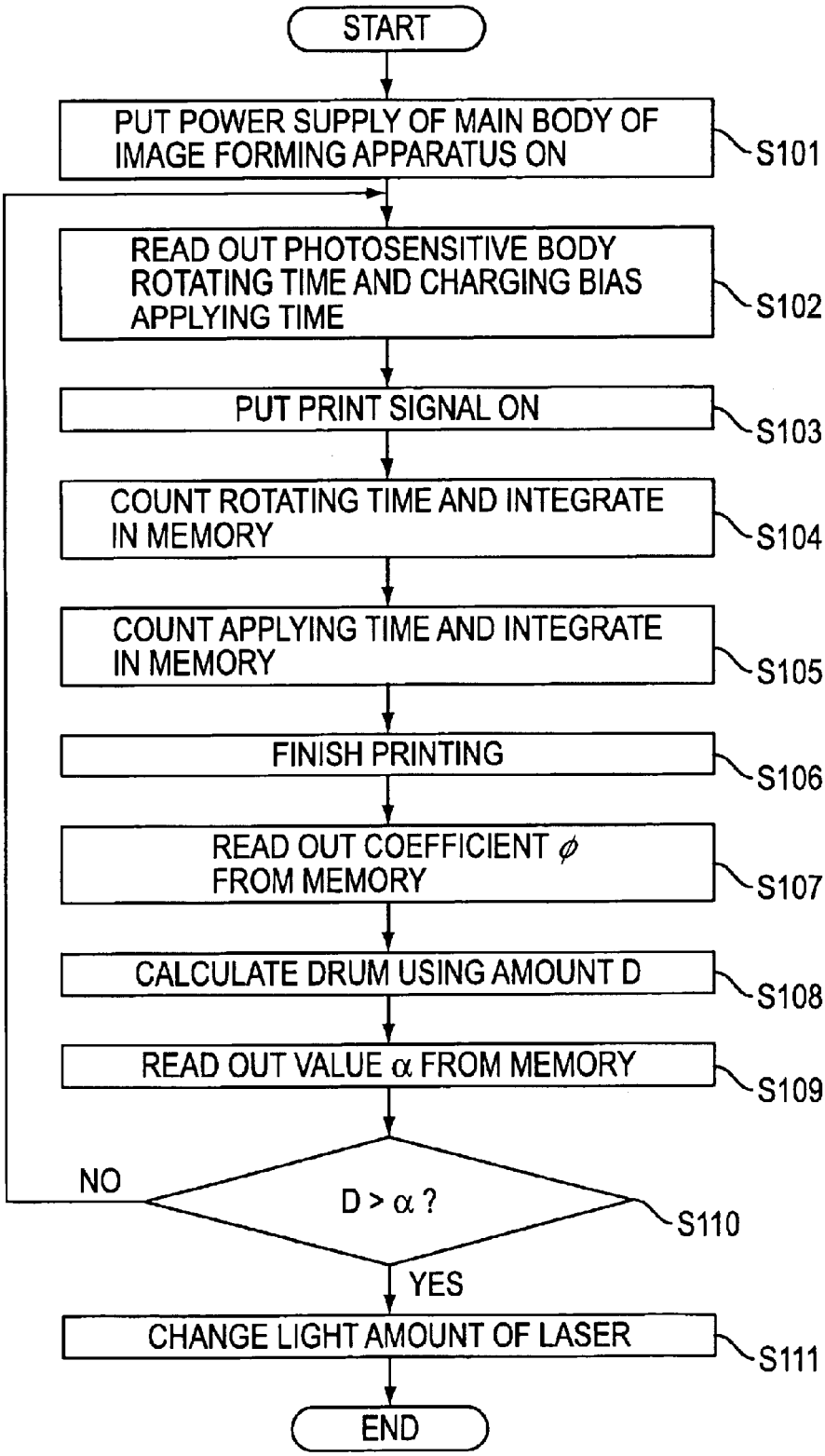
FIG. 6 is a flowchart showing an embodiment of a process control operation involved in the present invention.

Next, the operation of the image forming apparatus in this embodiment will be described by using the flowchart in FIG. 6.

Start

S101: Turn on the power of the image forming apparatus main body.

S102: Read from the memory 22 of the cartridge C the totalized value of the photosensitive body rotation time and the charging bias application time so far.

S103: The print signal ON.

S104: The photosensitive body rotation instructing portion 27 starts counting the rotation time and totalizes it with the photosensitive body rotation time read from the memory 22.

S105: The charging bias application time detecting portion 28 starts counting the charging bias application time and totalizes it with the charging bias application time read from the memory 22.

S106: Printing completed.

S107; The weighting coefficient $\phi$ is read from the memory 22 of the cartridge.

S108: The drum used amount D is calculated in the computing portion 26.

S109: The drum used amount arithmetic expression threshold $\alpha$ is read by the apparatus main body control portion 24.

S110: The drum used amount data D is compared to the drum used amount arithmetic expression threshold $\alpha$ by the computing portion 26. To be more specific, it is determined whether $D>\alpha$ or not. If determined as "YES", it proceeds to the step S111, and if determined as "NO", it returns to the step S102 and repeats the control.

S111: A switching signal is transmitted from the control portion 25 to a laser exposure unit 3 shown in FIG. 5 so that the amount of exposure to light is changed.

End

Figure 7:
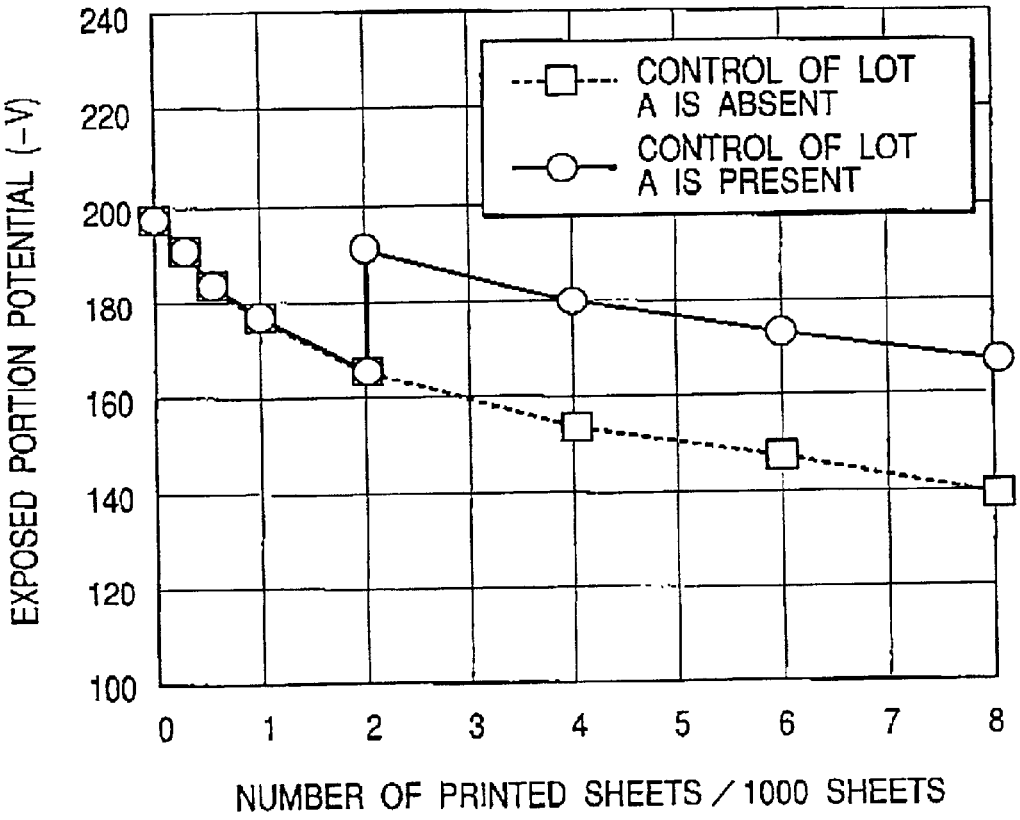
FIG. 7 is a graph showing the relationship between the number of printed sheets and the exposed portion potential in a manufacturing lot A depending on whether the control is present or absent.
Figure 8:
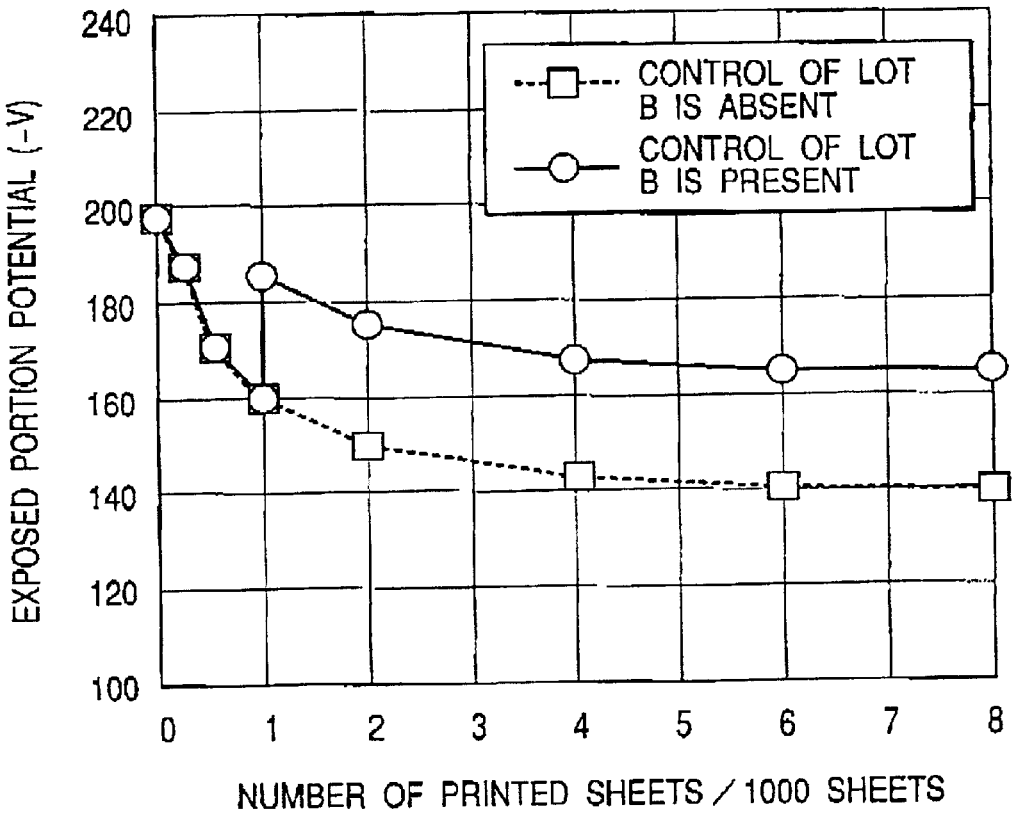
FIG. 8 is a graph showing the relationship between the number of printed sheets and the exposed portion potential in a manufacturing lot B depending on whether the control is present or absent.

FIG. 7 and FIG. 8 show the effect acquired by performing control of the amount of exposure as shown in the above flowchart.

FIG. 7 shows the respective cases where control of the amount of exposure is present and absent as to transition of an exposure portion potential VI of the photosensitive drum of the lot A. In this example, the drum used amount arithmetic expression threshold $\alpha$ is the drum used amount equivalent to 2,000 sheets.

FIG. 8 shows transition of the exposed portion potential VI in the lot B in the respective cases where the control is present and absent. In this example, the drum used amount arithmetic expression threshold $\alpha$ is the drum used amount equivalent to 1,000 sheets.

As is understandable from FIG. 7 and FIG. 8, potential variation that was 60 V or so is now within 40 V or so by performing control of the amount of exposure of this embodiment.

Moreover, while the current value is switched just once in this embodiment, it may be a plurality of stages according to each individual property, and besides, the current value can be increased or decreased according to the state of each individual cartridge. In addition, while it shows a case where the drum used amount data threshold is one, it may also be a plurality.

Embodiment 2

Figure 9:
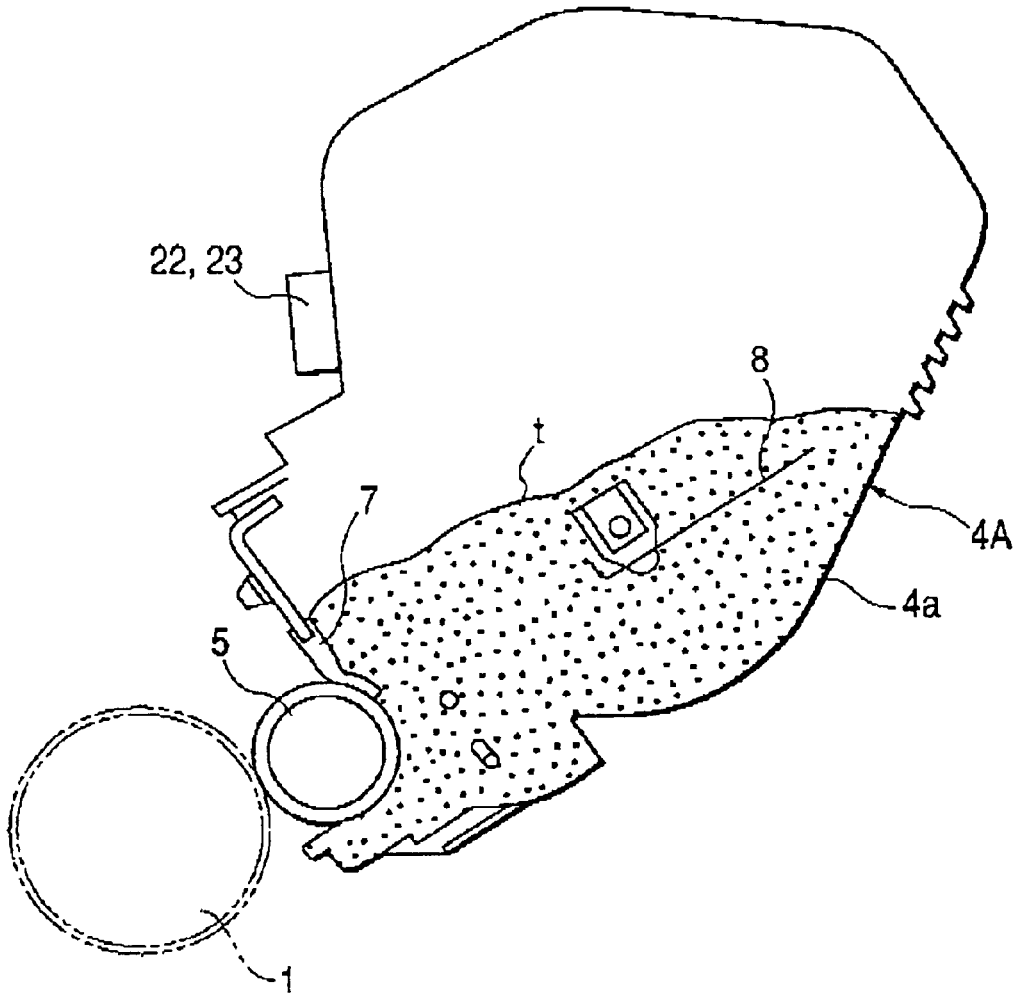
FIG. 9 is a sectional view showing an embodiment of a developing apparatus rendered as a cartridge involved in the present invention.
Figure 10:
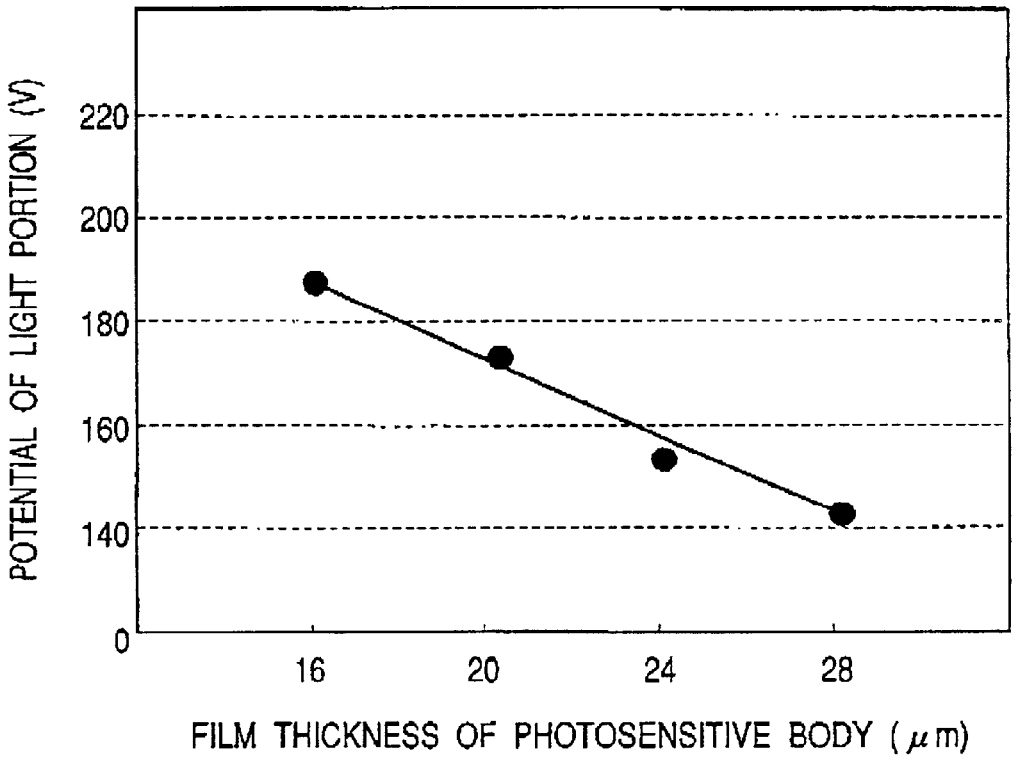
FIG. 10 is a graph showing a conventional relationship between a drum's film thickness and a light portion potential.

FIG. 9 shows an embodiment of a developing apparatus 4A rendered as a cartridge that is another form of the present invention. As for the developing apparatus 4A of the present invention, a developer carrying body such as the development sleeve 5 and the developer container 4*a* accommodating the developer t to supply the developer t thereto are rendered as a cartridge as one piece. To be more specific, it can be considered as a cartridge made by integrating the process cartridge C described in the first embodiment after eliminating the photosensitive drum 1, the charging roller 2 and the cleaning means 6 therefrom.

Accordingly, the same action and effect as in the first embodiment can be achieved by applying the configuration described in the first embodiment to this embodiment.

While the invention has been described with reference to the structure disclosed herein, it is not confined to the details set forth and this application is intended to cover such modifications or changes as may come within the purposes of the improvements or the scope of the following claims.

What is claimed is:

1. An image forming apparatus comprising:

a cartridge detachably mounted thereon, said cartridge including a storage medium capable of storing electronic information and a part of plural process means for image formation including a photosensitive body on which an electrostatic latent image is formed, charging means for charging said photosensitive body, development means for developing the electrostatic latent image formed on said photosensitive body, and exposing means for exposing said photosensitive body;

means for detecting a driven amount of said cartridge; and control means for changing an exposure condition of said exposing means for exposing said photosensitive body on the basis of the information stored in said storage medium, wherein said storage medium stores, in advance (1) threshold information relating to a threshold value used to change the exposure condition for said exposing means to expose said photosensitive body and (2) arithmetic coefficient information used to calculate used amount information of said cartridge, said storage medium having an area for storing information on the driven amount of said cartridge, and wherein said control means calculates the used amount information of said cartridge on the basis of the driven amount information and the arithmetic coefficient information, and when a value obtained by the calculation of said control means reaches the threshold value, said control means changes the exposure condition for said exposing means.

2. An image forming apparatus according to claim 1, wherein the driven amount of the cartridge is the rotation time of said photosensitive body or the bias application time during which said charging means charges said photosensitive body, and wherein the used amount information of said cartridge is a value obtained by weighting the rotation time using the arithmetic coefficient information, or a value obtained by weighting the bias application time using the arithmetic coefficient information.

3. An image forming apparatus according to claim 1, wherein said threshold information used to change the exposure condition for said exposing means includes at least one of a value related to a manufacturing lot of said photosensitive body, a value related to an electrical characteristic of said charging means, and information related to the contact pressure of a cleaning blade abutting against said photosensitive body.

4. An image forming apparatus according to claim 1, wherein said storage medium stores a table corresponding to said threshold information and said exposure condition.

5. A cartridge detachably mountable on a main body of an image forming apparatus, the image forming apparatus including a photosensitive body on which an electrostatic latent image is formed, charging means for charging the photosensitive body, developing means for developing the electrostatic latent image formed on the photosensitive body, and exposing means for exposing the photosensitive body, said cartridge comprising:

a storage medium capable of storing electronic information, wherein said storage medium stores, in advance, (1) threshold information relating to a threshold value used to change an exposure condition for the exposing means to expose the photosensitive body and (2) arithmetic coefficient information used to calculate a used amount of said cartridge, said storage medium having an area for storing information on the driven amount of said cartridge.

6. A cartridge according to claim 5, wherein the driven amount information of said cartridge is the rotation time of the photosensitive body or the bias application time for the charging means.

7. A cartridge according to claim 5, wherein said threshold information used to change the exposure condition for the exposing means includes at least one of a value related to a manufacturing lot of the photosensitive body, a value related to an electrical characteristic value of the charging means, and information related to the contact pressure of a cleaning blade abutting against the photosensitive body.

8. A cartridge according to claim 5, wherein said storage medium stores a table corresponding to said threshold information and said exposure condition.

9. An image forming system for forming an image on a recording medium by using a cartridge detachably attachable to an image forming apparatus, said system comprising:

said cartridge; and said image forming apparatus, wherein said cartridge includes a storage medium capable of storing electronic information and a part of plural process means for image formation including a photosensitive body on which an electrostatic latent image is formed, charging means for charging said photosensitive body, and developing means for developing the electrostatic latent image formed on said photosensitive body, wherein said image forming apparatus includes exposing means for exposing said photosensitive body, means for detecting a driven amount of said cartridge, and control means for changing an exposure condition of said exposing means for exposing said photosensitive body on the basis of the information stored in said storage medium, wherein said storage medium stores, in advance (1) threshold information relating to a threshold value used to change the exposure condition for said exposing means to expose said photosensitive body and (2) arithmetic coefficient information used to calculate used amount information of said cartridge, said storage medium having an area for storing information on the driven amount of said cartridge, and wherein said control means calculates the used amount information of said cartridge on the basis of the driven amount information and the arithmetic coefficient information, and when a value obtained by the calculation of said control means reaches the threshold value, said control means changes the exposure condition for said exposing means.

10. An image forming system according to claim 9, wherein the driven amount of said cartridge is the rotation time of said photosensitive body or the bias application time during which said charging means charges said photosensitive body, and wherein the used amount information of said cartridge is a value obtained by weighting the rotation time using the arithmetic coefficient information, or a vlaue obtained by weighting the bias application time using the arithmetic coefficient information.

11. An image forming system according to claim 9, wherein said threshold information used to change the exposure condition for said exposing means includes at least one of a value related to a manufacturing lot of said photosensitive body, a value related to an electrical characteristic of said charging means, and information related to the contact pressure of a cleaning blade abutting against said photosensitive body.

12. An image forming system according to claim 9, wherein said storage medium stores a table corresponding to said threshold information and said exposure condition.

13. A storage medium for storing electronic information, wherein said storage medium is mounted on a cartridge detachably mountable on a main body of an image forming apparatus,wherein the image forming apparatus includes means for detecting a driven amount of the cartridge, a photosensitive body on which an electrostatic latent image is formed, charging means for charging the photosensitive body, developing means for developing the electrostatic latent image formed on the photosensitive body, and exposing means for exposing the photosensitive body, wherein said storage medium stores, in advance (1) threshold information relating to a threshold value used to change an exposure condition for the exposing means to expose the photosensitive body and (2) arithmetic coefficient information used to calculate a used amount of the cartridge, and wherein said storage medium has an area for storing information on the driven amount of the cartridge.

14. A storage medium according to claim 13, wherein the dirven amount of the cartridge is the rotation time of the photosensitive body or the bias application time during which the charging means charges the photosensitive body, and wherein the arithmetic coefficient information used to calculate the used amount of the cartridge is information for weighting the rotation time of the photosensitive body or the bias application time for the charging means.

15. A storage medium according to claim 13, wherein the threshold information used to change the exposure condition for the exposure means to expose the photosensitive body includes at least one of a value related to a manufacturing lot of the photosensitive body, a value related to an electrical characteristic value of the charging means, and information related to the contact pressure of a cleaning blade abutting against the photosensitive body.

16. A storage medium according to claim 13, wherein said storage medium stores a table corresponding to said threshold information and said exposure condition.

17. A cartridge according to claim 5, further comprising the photosensitive body, the charging means, and the developing means.

18. A storage medium according to claim 13 in combination with the cartridge, the cartridge comprising the photosensitive body, the charging means, the developing means.

19. A storage medium to be mounted on a cartridge being usable with a main body of an image forming apparatus, wherein the image forming apparatus includes a photosensitive body on which an electrostatic latent image is formed, a charging member configured to charge the photosensitive body, a developing member configured to develop the electrostatic latent image formed on the photosensitive body, a detector configured to detect a driven amount of the photosensitive body, and an exposing device configured to expose the photosensitive body, wherein said storage medium stores, in advance (1) threshold information relating to a changing exposure condition for the exposing device, and (2) arithmetic coefficient information used to calculate a used amount of the cartridge, and wherein said storage medium has an area configured to store information relating to the driven amount of the photosensitive body detected by said detector.

20. A storage medium according to claim 19, wherein said storage medium stores a table corresponding to the threshold information and the exposure condition.

21. A storage medium according to claim 19, wherein the cartridge comprises the photosensitive body, and charging member, and the developing member.

* * * * *

UNITED STATES PATENT AND TRADEMARK OFFICE

CERTIFICATE OF CORRECTION

PATENT NO. : 6,850,714 B2
DATED : February 1, 2004
INVENTOR(S) : Sakurai et al.

It is certified that error appears in the above-identified patent and that said Letters Patent is hereby corrected as shown below:

Title page,
Item [56], References Cited, FOREIGN PATENT DOCUMENTS,
"58132758" should read -- 58-132758 --.
"05257343" should read -- 5-257343 --.
"09120245" should read -- 9-120245 --
"10031332" should read -- 10-31332 --.

Column 3,
Line 8, "above described" should read -- above-described --.
Line 10, "Image" should read -- image --.

Column 4,
Line 12, "thereof" should read -- thereof. --.

Column 6,
Line 22, "voltage;" should read -- voltage: --.

Column 7,
Line 45, "restrictions" should read -- restrictions. --.

Column 14,
Line 28, "means," should read -- means, and --.

Signed and Sealed this

Thirty-first Day of May, 2005

JON W. DUDAS
*Director of the United States Patent and Trademark Office*